US007537134B2

(12) United States Patent
Lee

(10) Patent No.: US 7,537,134 B2
(45) **Date of Patent: *May 26, 2009**

(54) SELF-CLOSING FLUID CONTAINER

(76) Inventor: Richard S. Lee, 2461 Birkhall Way, Lawrenceville, GA (US) 30043

( * ) Notice: Subject to any disclaimer, the term of this patent is extended or adjusted under 35 U.S.C. 154(b) by 724 days.

This patent is subject to a terminal disclaimer.

(21) Appl. No.: 11/167,859

(22) Filed: Jun. 27, 2005

(65) Prior Publication Data

US 2006/0289540 A1 Dec. 28, 2006

(51) Int. Cl.
*B65D 51/18* (2006.01)
*A47G 19/22* (2006.01)
*B65D 43/16* (2006.01)

(52) U.S. Cl. ..... 220/719; 220/257.2; 220/281; 220/714

(58) Field of Classification Search ..... 220/719, 220/233, 714, 254.1, 254.3, 256.1, 257.1, 220/257.2, 259.1, 264, 262, 281
See application file for complete search history.

(56) References Cited

U.S. PATENT DOCUMENTS

| | | | | | |
|---|---|---|---|---|---|
| 770,281 | A | | 9/1904 | Green | |
| 799,568 | A | | 9/1905 | Hovey | |
| 3,015,411 | A | * | 1/1962 | Smith | 220/714 |
| 3,208,629 | A | * | 9/1965 | Beeson | 220/714 |
| 3,964,631 | A | * | 6/1976 | Albert | 220/715 |
| 3,967,748 | A | * | 7/1976 | Albert | 220/715 |
| 3,972,443 | A | * | 8/1976 | Albert | 220/715 |
| 3,990,598 | A | | 11/1976 | Zapp et al. | |
| 4,094,433 | A | * | 6/1978 | Numbers | 220/715 |
| 4,133,446 | A | * | 1/1979 | Albert | 220/715 |
| 4,138,033 | A | * | 2/1979 | Payne et al. | 220/254.3 |
| 4,184,603 | A | * | 1/1980 | Hamilton, Sr. | 220/254.9 |
| 4,361,249 | A | * | 11/1982 | Tuneski et al. | 220/254.3 |
| 4,441,624 | A | * | 4/1984 | Sokolowski | 220/254.1 |
| 4,691,839 | A | | 9/1987 | Ullman | |
| 4,706,855 | A | | 11/1987 | Litwin | |
| 4,784,283 | A | | 11/1988 | Cantu | |
| 5,044,529 | A | | 9/1991 | Campbell | |
| 5,199,597 | A | | 4/1993 | Gladish | |
| 5,381,924 | A | | 1/1995 | Kiefel | |
| 5,395,000 | A | * | 3/1995 | Porter | 215/267 |
| 5,452,818 | A | | 9/1995 | Yost | |
| 5,485,871 | A | * | 1/1996 | Romanek et al. | 141/312 |
| 5,485,938 | A | * | 1/1996 | Boersma | 220/714 |
| 5,706,972 | A | | 1/1998 | Sousa | |
| 5,810,189 | A | * | 9/1998 | Baker | 220/257.2 |
| 6,053,347 | A | | 4/2000 | Fullin | |
| 6,073,797 | A | | 6/2000 | Barous | |

(Continued)

*Primary Examiner*—Anthony D Stashick
*Assistant Examiner*—Niki M Eloshway
(74) *Attorney, Agent, or Firm*—Greer, Burns & Crain, Ltd.

(57) ABSTRACT

An apparatus for closing an opening created by a removal of a breakable seal on a liquid container includes a stopper configured to overlap or cover the opening, an elongated arm having an end attached to the stopper for exerting a force on the stopper against the opening, and a flexible bridge having two ends which are affixed on the opposite sides of the wall of the container. A connection line has a first end secured to the stopper and a second end secured to the bridge. The opening is opened by applying force towards a middle of the bridge at the two ends and enabling the bridge to pull the stopper away from the opening via the connection line.

20 Claims, 11 Drawing Sheets

U.S. PATENT DOCUMENTS 6,305,570 B1 * 10/2001 Atkin et al. ..... 220/714
6,478,179 B1 11/2002 Alexander
6,508,379 B1 * 1/2003 Van De Pol-Klein Nagelvoort et al. ..... 220/714
6,739,471 B2 5/2004 Goetz et al.
7,210,591 B2 * 5/2007 Goldman et al. ..... 215/11.1
7,351,467 B2 * 4/2008 Blonder ..... 428/132
2003/0127413 A1 * 7/2003 Spinelli et al. ..... 215/11.4
2006/0043096 A1 * 3/2006 Naesje ..... 220/714
2006/0283856 A1 * 12/2006 Spinelli et al. ..... 220/201

* cited by examiner

SELF-CLOSING FLUID CONTAINER

FIELD OF INVENTION

The present invention relates containers, and in particular, to a container for holding fluid and having a self-closing stopper for automatically closing the container opening.

BACKGROUND OF THE INVENTION

Containers for holding liquids such as carbonated and non-carbonated beverages and other liquids typically come in cans made from aluminum and/or similar materials. Access to such containers is commonly made through a puncturable seal on top of the can. Such conventional cans provide no means for resealing the container once opened. Accordingly, open cans quite frequently experience spillage or loss of carbonation (if the content is carbonated). It is also impracticable to save the content of the container for a later use, since there is also no readily available means for closing the opening to prevent contamination or loss of flavor, thereby forcing the individual to either use the entire content of the container within a relatively short time after opening or throw away the unused content.

SUMMARY OF THE INVENTION

The present invention is directed to an apparatus for closing an opening created by a removal of a breakable seal on a liquid container. The apparatus includes a stopper configured to overlap or cover the opening, an elongated arm having an end attached to the stopper for exerting a force on the stopper against the opening, and a flexible bridge having two ends which are affixed on opposite sides of the wall of the container. A connection line has a first end secured to the stopper and a second end secured to the bridge. The opening is opened by applying force towards a middle of the bridge at the two ends and enabling the bridge to pull the stopper away from the opening via the connection line.

DETAILED DESCRIPTION OF THE INVENTION

Broadly stated, the present invention is directed to an apparatus for preventing spillage of liquid inside a container and loss of carbonation, if the liquid is carbonated. The apparatus is provide inside the container and includes an arm that has a stopper that covers opening in the container. The arm is attached to a bridge which also has a connection line connected to the stopper. To open the container, the opposite sides of the container is depressed by a person's fingers. This causes the bridge to bend down or expand, pulling the stopper away from the opening via the connection line. To close the opening, the pressure on the container is released to enable the container to retain its shape, and allow the arm to urge the stopper against the opening.

Figure 1:
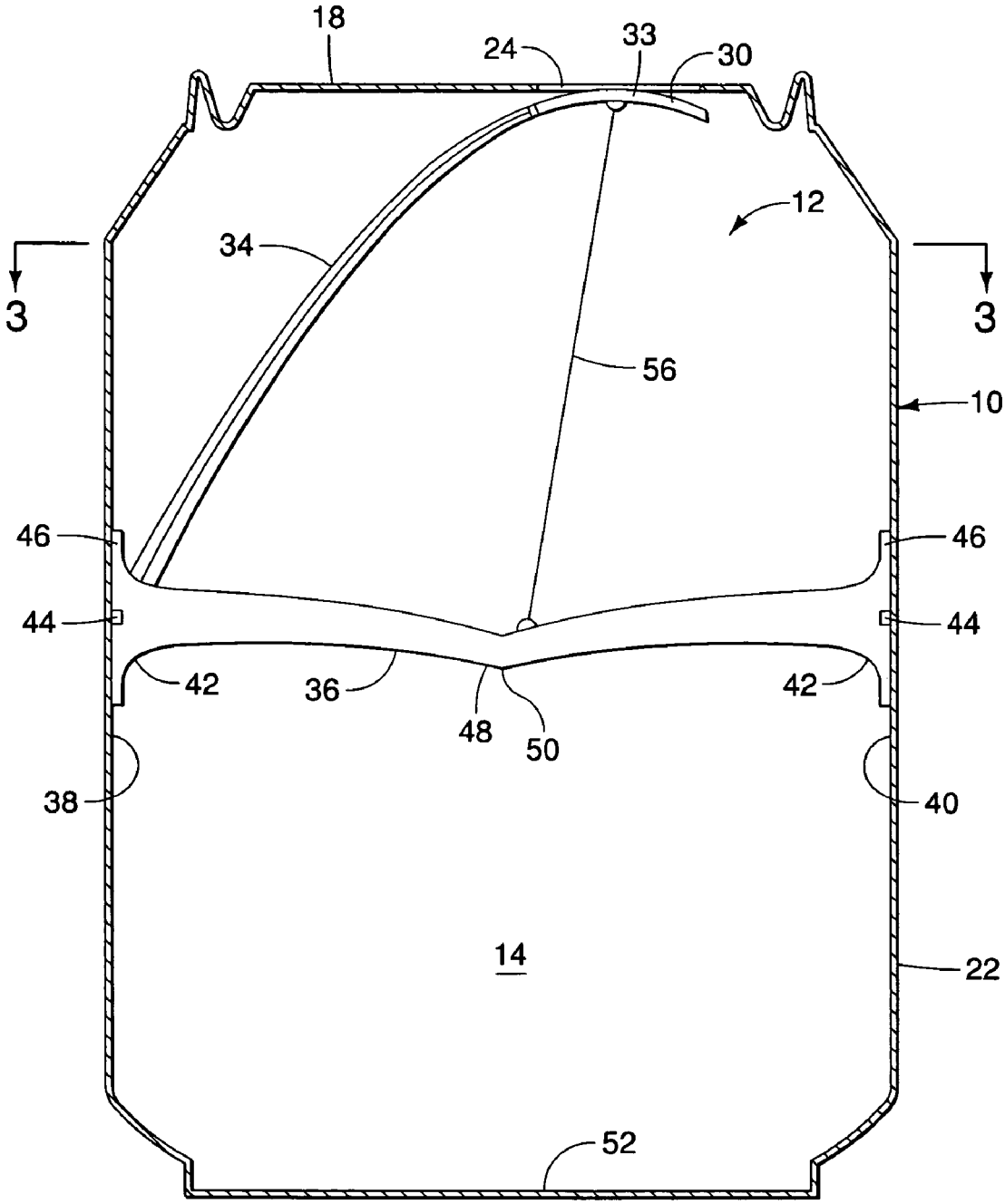
FIG. 1 is a side view of a sealing mechanism in accordance with one embodiment of the present invention, shown provided inside a container.

Turning now to FIG. 1, the present invention in accordance with one embodiment includes a container 10 and a sealing mechanism 12 provided inside 14 the container for automatically sealing an opening 16 (best shown in FIG. 7) on the top 18 of the container. The container 10, in one embodiment, is a metal can, preferably aluminum, for holding contents such as carbonated beverages, fruit juices, beer, tea or sports drinks, for example. The container 10 may also hold liquid medicine or other liquids such as, for example, motor or transmission oil. The container 10 may also be formed from material such as plastic that retains its shape when no external force is applied. The container 10, either an aluminum can or plastic, is sufficiently flexible, at least towards the middle portion 20 of the container, so that when inward pressing external force is exerted on the side 22 of the container, it deforms inwardly, and returns to its original shape when the deforming force is removed.

Figure 2:
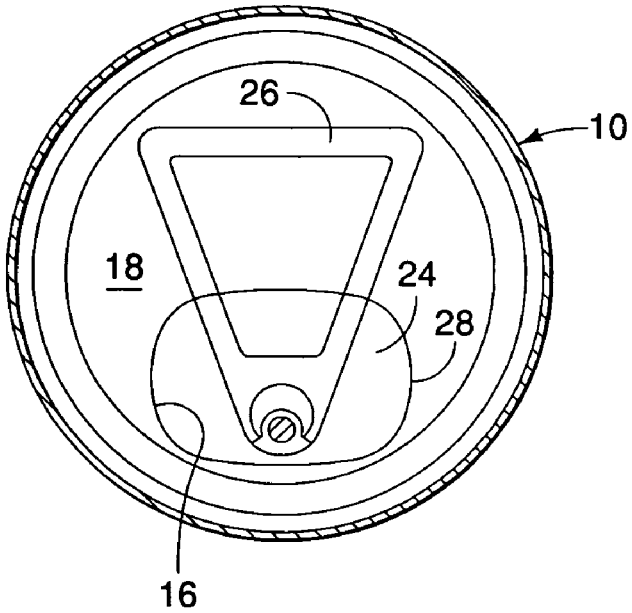
FIG. 2 is a top view of the container shown in FIG. 1, in accordance with one embodiment of the present invention.

Referring to FIG. 2, the top 18 of the container 10 is substantially planar and includes a scored plate 24 which is removable by a pull-tab 26 attached to the plate and configured to lie substantially flat on the top 18 of the container. To remove the plate 24, the pull-tab 26 is lifted off the top 18 of the container 10 at the distal end from the plate 24, so as to pivot and separate the plate 24 at a score 28 from the container. Thus, the opening 16 is created in the generally oval shape of the plate 24. The pull-tab 26 and the plate 24 are discarded once separated from the container 10.

Figure 3:
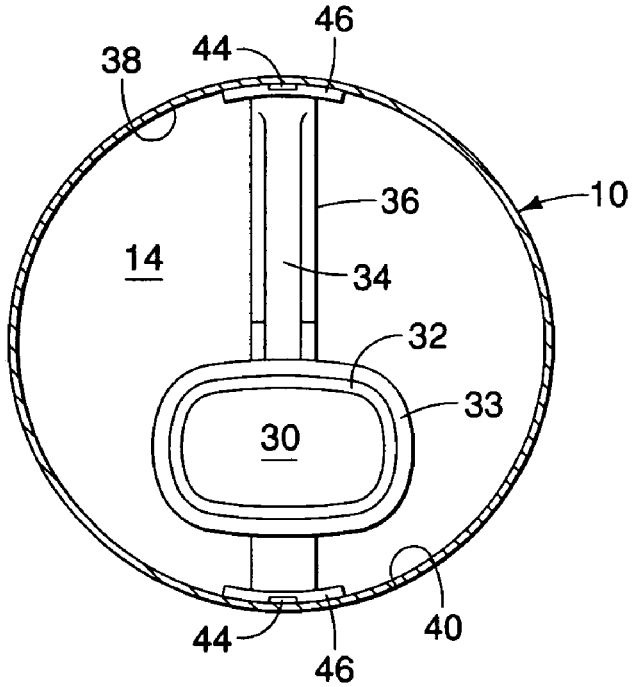
FIG. 3 is a top view of the sealing mechanism of FIG. 1.

As shown in FIGS. 1 and 3, the sealing mechanism 12 includes a stopper 30, generally in the outline of the opening 16. The stopper 30 is slightly larger than the opening 16 so that it completely covers the entire area of the opening. The stopper 30 may be substantially planar or convex when view from the top to better seal the opening 16, and is formed from a material such as plastic, which should be slightly flexible so as to better seal the opening 16.

In one embodiment, a sealing ring or gasket 32 is adhered to an upper surface 33 of the stopper 30 facing the opening 16. The sealing ring 32 has a shape similar to, and a size sufficient to surround the opening 16. The sealing ring 32 is made of softer plastic material than that of the stopper 30, so as to provide a substantially liquid and gas proof seal around the opening 16 when the stopper 30 is pressed against opening. The sealing ring or gasket 32 may also be formed from rubber or other semi-soft material that is capable of providing a substantially tight fluid seal around the opening 16.

The stopper 30 is attached to one end of an elongated arm 34, which at the other end is attached to a bridge 36 that extends across the inside 14 the container 10 from one side 38 to the opposite side 40. In one embodiment, the stopper 30, the arm 34 and the bridge 36 are molded together as a single, plastic piece. These parts may also be formed separately and then attached together by glue or by a heat welding process, for example. Other suitable material for the stopper 30, the arm 34 and the bridge 36 may include metal wrapped in plastic.

The arm 34 is flexible and positioned within the container 10 so as to exert a force on the stopper 30 against the opening 16. More specifically, the arm 34 is flexed towards the bridge 36 so as to be urged against the inside the top 18 of the container 10, as shown in FIG. 1. The thickness of the arm 34 gradually narrows towards the stopper 30 from the end attached to the bridge 36 to provide the arm 34 added flexibility.

Figure 4:
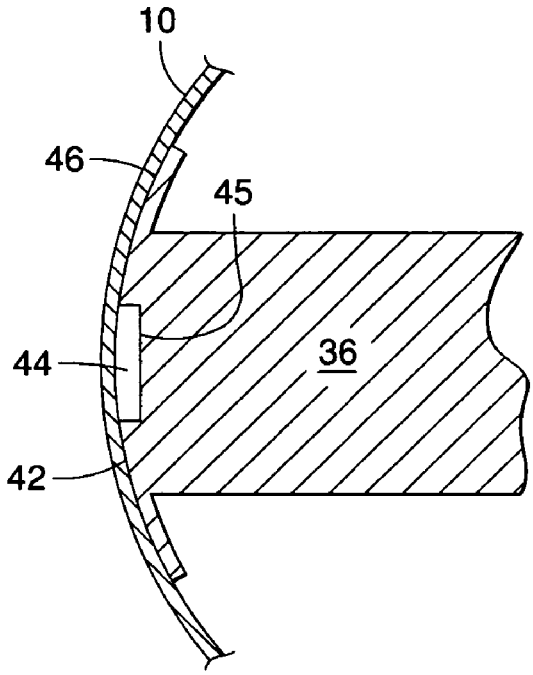
FIG. 4 is a sectional view of a portion of a bridge of the sealing mechanism for illustrating the manner in which the bridge is attached to the side of the container.

As shown in FIG. 4, the bridge 36 at each end 42 is fixedly attached to a post 44 which protrudes from the inside wall of the container 10, proximate the middle portion 20. The posts 44 each has a generally rectangular shape when viewed from the top and the bottom, and are matingly inserted into a corresponding cavity 45 formed in the ends 42 of the bridge 36. In one embodiment, the posts 44 are integral with the container 10, itself, and formed during the process for manufacturing the container by pushing or punching the side 22 of the container inwardly. The posts 44 may also be welded or riveted together to the sides 38, 40 of the container 10 (best shown in FIG. 1).

As shown in FIGS. 1 and 4, the bridge 36 at each end 42 also includes a pad 46 which is configured to enlarge the area of the ends 42. In this manner, the ends 42 of the bridge 36 are easily accessible for operating the sealing mechanism 12, as explained below. The bridge 36 also includes a hinged portion 50 at approximately the middle point 48 from the two opposite ends 42. The thickness of the bridge at the hinged portion 50 is smaller than the other parts of the bridge 36, and narrows gradually from the ends 42 to provide the hinged portion its smaller thickness. The bridge 36 also extends at a slight angle towards the hinged portion 50 so that the bridge 36 is slightly lower at the hinged portion 50 than at the ends 42. This arrangement allows the bridge 36 to bend at the hinged portion 50 towards a bottom 52 of the container 10, i.e., away from the opening 16, when the sides 38, 40 of the container at the pads 46 are depressed.

Figure 5:
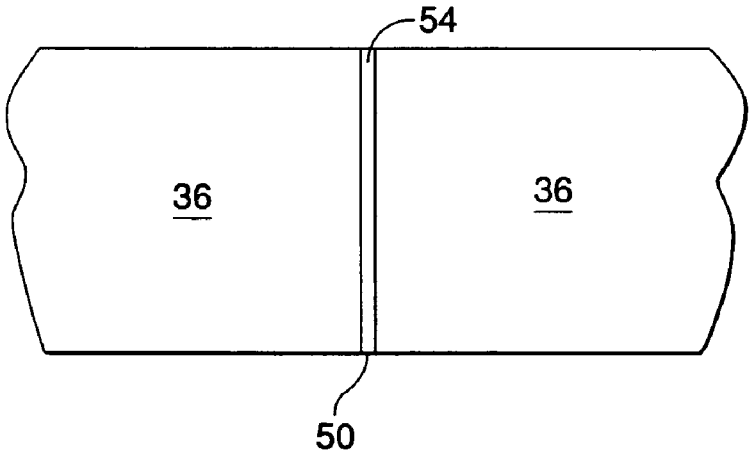
FIG. 5 is a diagram illustrating an alternate embodiment of a hinged portion of the bridge of the sealing mechanism.

In another embodiment, of the hinged portion 50 includes a slit 54 that extends across the width of the bridge, as shown in FIG. 5. The slit 54 is sufficiently wide and deep as to assist the bridge 36 to bend or give at the hinged portion 50 when force is exerted towards the hinged portion from the opposite ends 42 of the bridge 36.

Referring back to FIG. 1, the sealing mechanism 12 also includes a connection line 56 secured at one end to the stopper 30 and at the other end to the bridge 36 proximate the hinged portion 50. The connection line 56 in one embodiment is a plastic or nylon with a sufficient tensile strength to pull the stopper 30 away from the opening 16 against the tension created by the arm 34. In one embodiment, the connection line 56 is integral with the stopper 30 and the bridge 36, and formed simultaneously along with the stopper 30, the arm 34, the bridge 36 and the pads 46 in a molding process. The connection line 56 may also be glued or otherwise attached or connected to the stopper 30 and bridge 36 in a separate process from the other components of the sealing mechanism 12.

Figure 6:
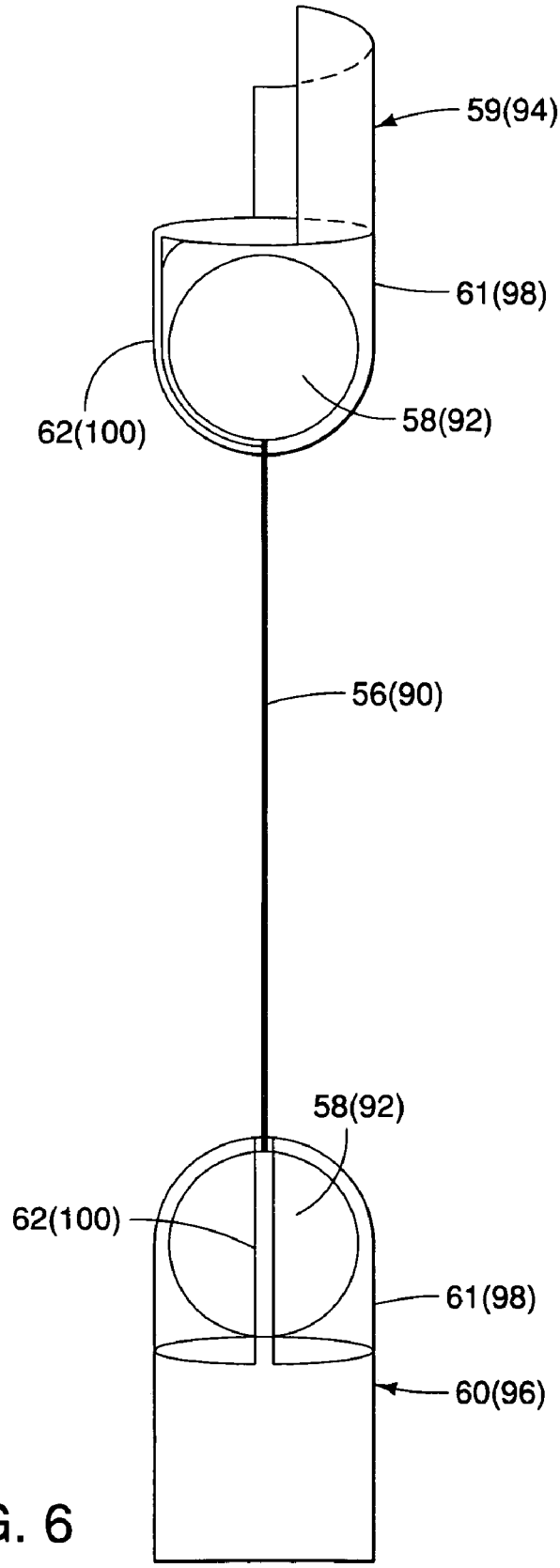
FIG. 6 illustrates one embodiment for securing a connection line in the sealing mechanism.

In yet another embodiment, and referring to FIG. 6, the two ends of the connection line 56 each terminates in an integrally formed ball 58. The ball 58 at one end of the connection line 56 is secured to an anchor 59 projecting from the surface of the stopper 30 on the side opposite the surface 33 facing the opening 16, and the other ball 58 is secured to an anchor 60 protruding from the bridge 36 near the hinged portion 50. Each of the anchors 59, 60 includes a cup 61 with a slit 62 extending from a lip to a bottom of the cup. The slits 62 enable the two balls 58 to be received in the two cups 61 to connect the connection line 56 to the two anchors 59, 60.

The length of the connection line 56 is such that it allows the stopper 30 to be pressed up against the opening 16 when the bridge 36 is not caused to be bent at the hinged portion 50. Preferably, the connection line 56 has a slight slack when the bridge 36 is not bent at the hinged portion 50. In this manner, the stopper 30 is maintained in the closed position against the opening 16 even when there is a slight bending at the hinged portion 50 due to unintentional or accidental deformation of the container 10, causing the hinged portion to bend downwardly and pulling the stopper 30 away from the opening.

Figure 7:
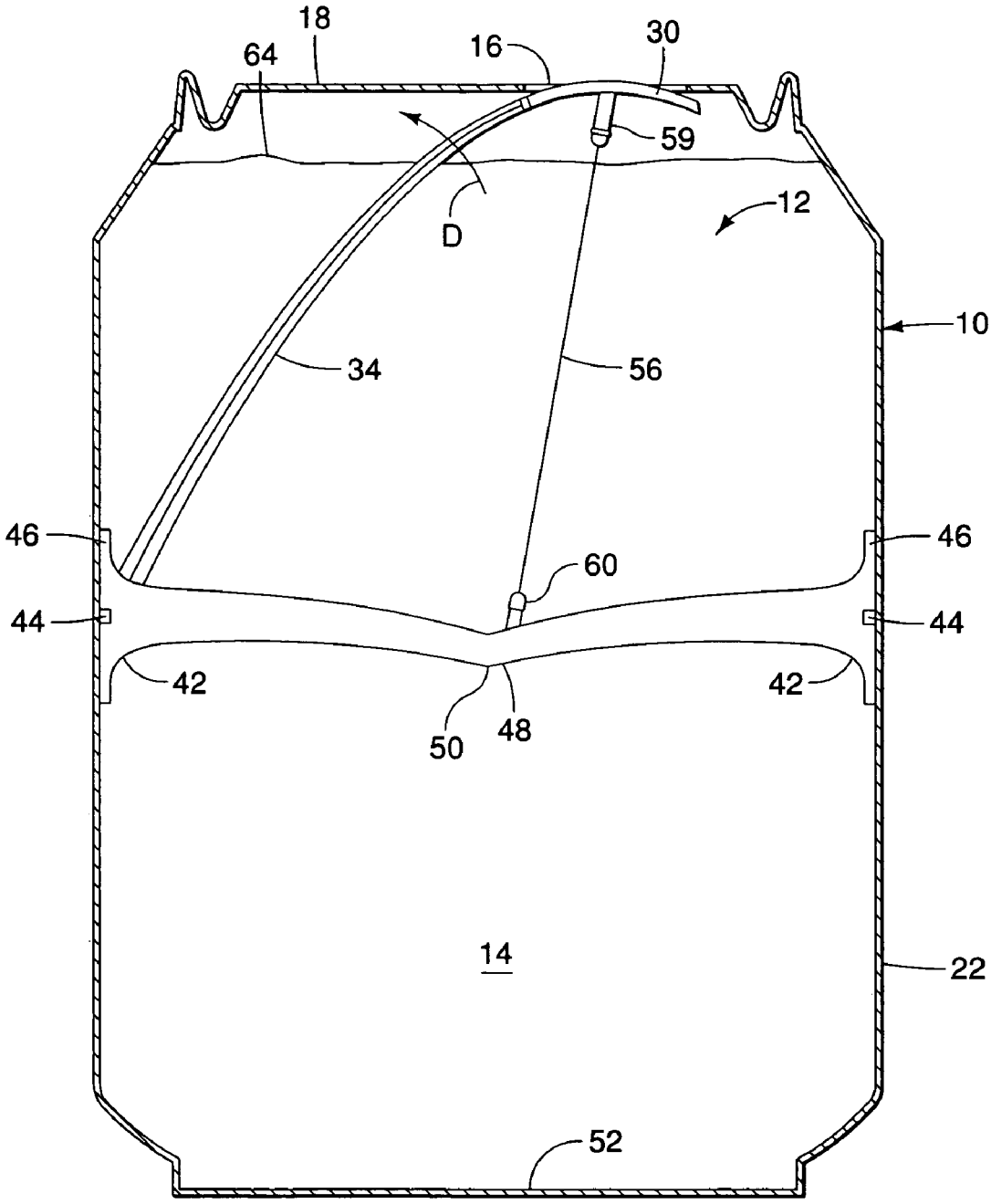
FIG. 7 shows the sealing mechanism of FIG. 1 in a closed position.
Figure 8:
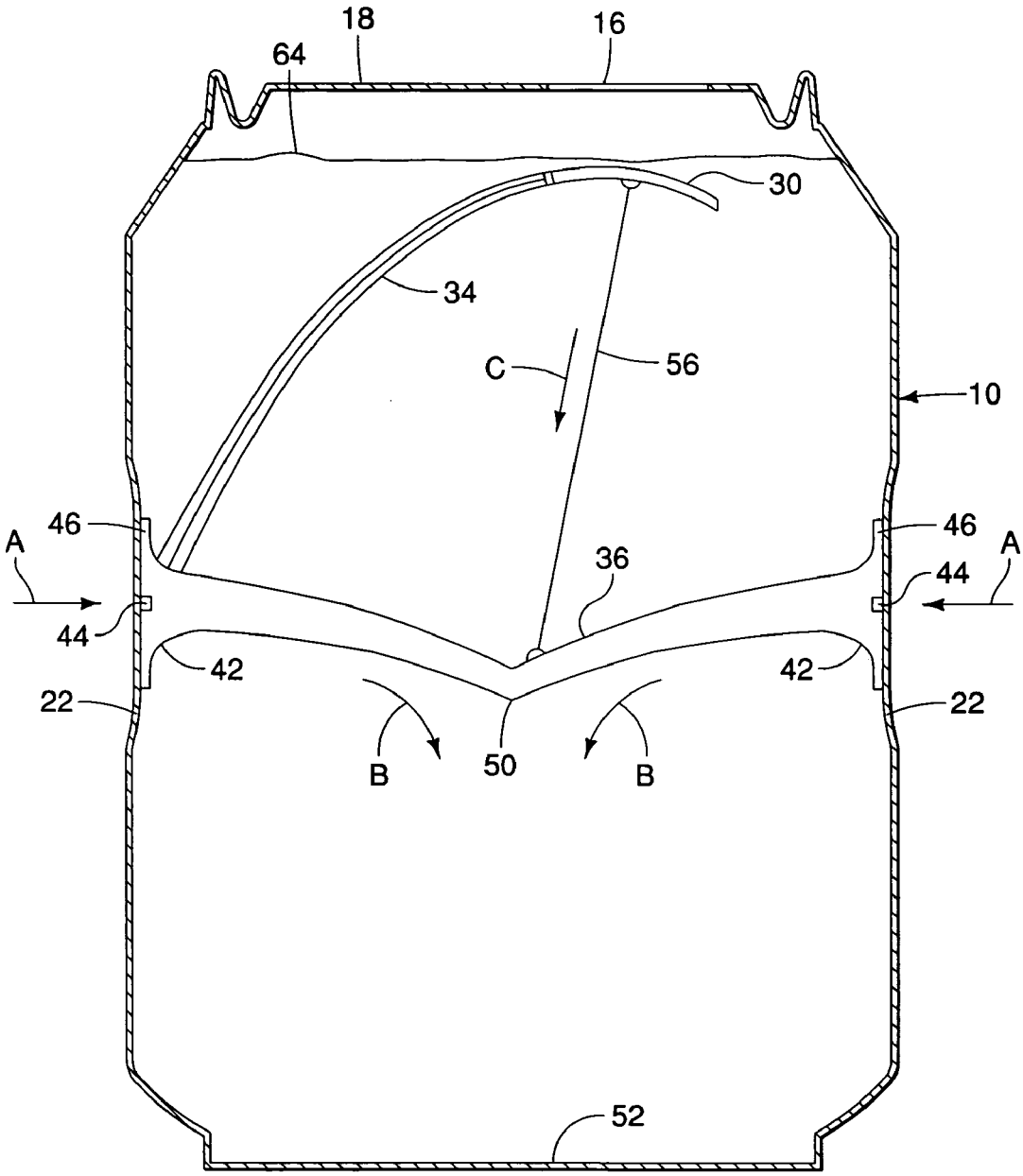
FIG. 8 shows the sealing mechanism of FIG. 2 in an open position.

Turning now to FIGS. 1, 7 and 8, and in operation, the sealing mechanism 12 is shown in a position where the stopper 30 is pressed up against the scored plate 24 when the container 10 is unopened. In other words, the plate 24 is still attached to the top 18 of the container 10 and has not been pulled off (shown in FIG. 1). When the plate 24 is detached from the top 18 of the container 10 using the pull-tab 26 (see FIG. 2), the stopper 30 is pressed or urged against the opening 16 by the arm 34, i.e., in a closed position (shown in FIG. 7). The sealing mechanism 12 automatically keeps the stopper 30 in a closed position when the container 10 is opened.

To place the sealing mechanism 12 in an open position and allow the content 64 of the container 10 to be released through the opening 16, the sides 22 of the container 10 is pressed inwardly at pads 46 (as indicated by arrows A in FIG. 8) using a thumb and a finger(s). This causes the bridge 36 to bend downwardly towards the bottom 52 of the container 10 at the hinged portion 50 (indicated by arrows B). The distance of the downward movement of the hinged portion 50 corresponds approximately to the inward deformation of the sides 22 of the container 10. The downward movement of the hinged portion 50 is translated to the stopper 30 via the connection line 56, causing a corresponding downward movement of the stopper (indicated by arrow C) away from the opening 16, and creating a gap between the stopper 30 and the opening. The content 64 of the container 10 is then allowed to exit through the opening 16.

To again place the sealing mechanism 12 in a closed position, the inward pressure at the sides 22 of the container 10 is removed by releasing the thumb and the finger(s) from the pads 46, or sufficiently releasing the pressure enough to allow the sides 22 of the container 10 to flex back to the state prior to being deformed. The inherent memory of the bridge 36, and to a lesser extent, the flexibility or the memory of the container 10, enables the sides 22 of container to regain its shape prior to the application of the inward pressure. More specifically, the bridge 36 unbends at the hinged portion 50 (in the direction opposite arrow B) and reverts back to the position prior to the application of the pressure on the sides 22. The removal of the tension on the connection line 56 allows the arm 34 to flex away from the bridge 36 and towards the top of the 18 of the container 10 (illustrated by arrow D in FIG. 7), where the stopper 30 is again positioned over the opening 16 at a tension provided by the arm 34. When the content 64 in the container 10 is a carbonated beverage, for example, pressure created by the gases also assists in pushing the stopper 30 securely against the opening 16.

Figure 9:
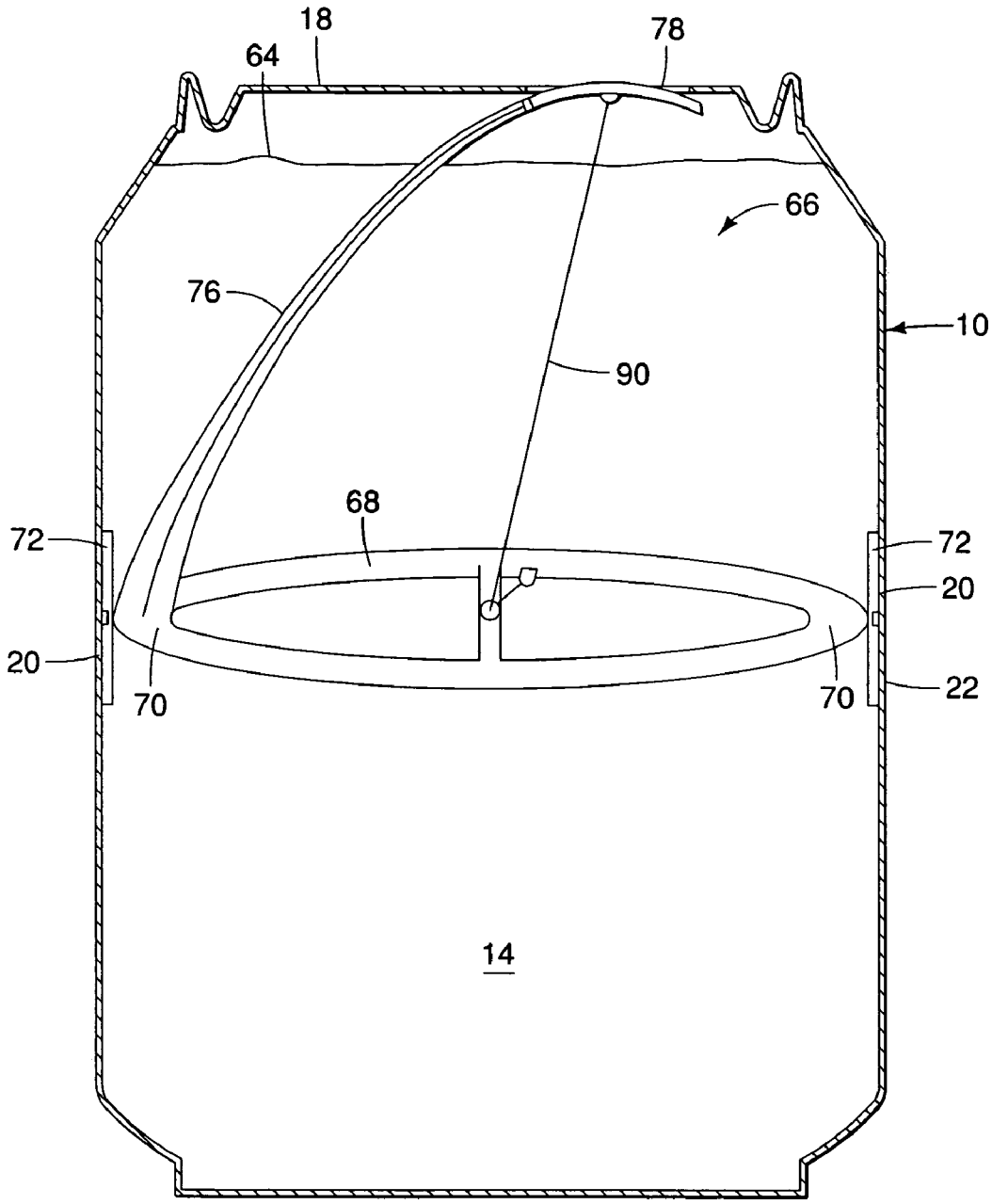
FIG. 9 is a perspective view of a sealing mechanism in accordance with another embodiment of the present invention, shown provided inside the container.
Figure 10:
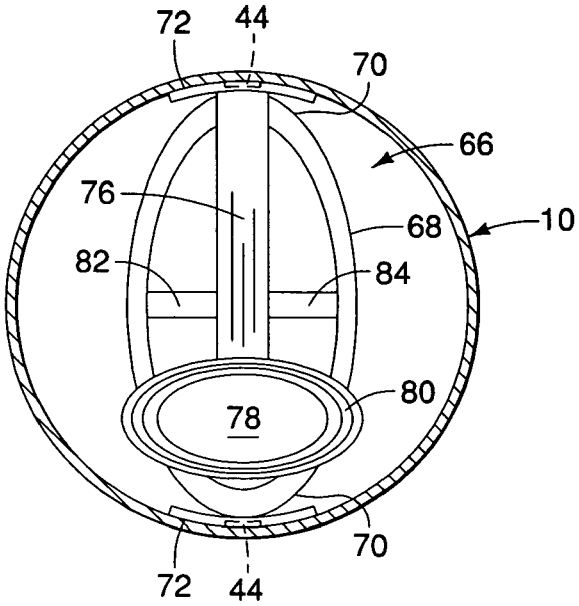
FIG. 10 is a top view of the sealing mechanism shown in FIG. 9.

Turning now to FIGS. 9 and 10, a sealing mechanism 66 in accordance with another embodiment of the present invention, includes a substantially elliptical or oval shaped bridge 68. The cross section of the bridge 68 is also elliptical or oval shaped in one embodiment. However, other shapes of the cross section may also be used, circular, for example. Two opposite ends 70 of the longest diameter of the bridge 68 includes pads 72, similar to the pads 46, for enlarging the area for operating the bridge 68, as described further below.

Figure 11:
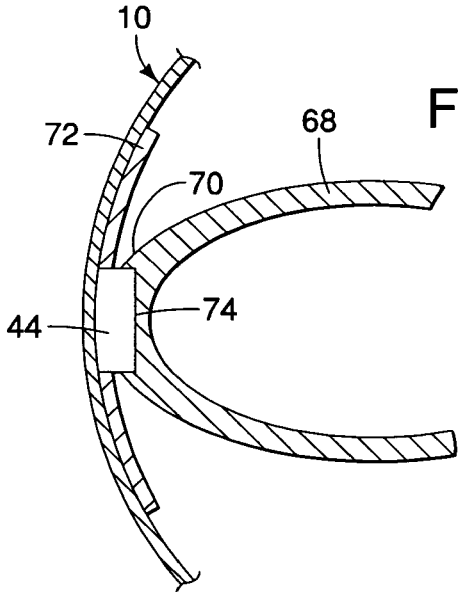
FIG. 11 is a top sectional view of a portion of a bridge of the sealing mechanism shown in FIG. 10 for illustrating the manner in which the bridge is attached to the side of the container.
Figure 12:
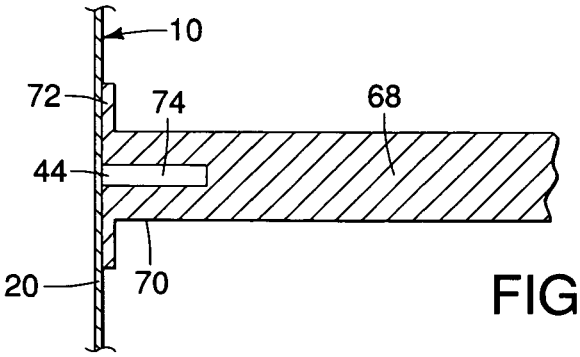
FIG. 12 is a side sectional view of a portion of a bridge of the sealing mechanism shown in FIG. 10 for illustrating the manner in which the bridge is attached to the side of the container.

Referring to FIGS. 11 and 12, the two ends 70 of the bridge 68 are affixed to the inside wall of the container 10, proximate the middle portion 20 using the posts 44 described above. Accordingly, the bridge 68 at each end 70 also includes a cavity 74 for matingly receiving the posts 44 and fixedly securing the bridge to the container 10.

Figure 13:
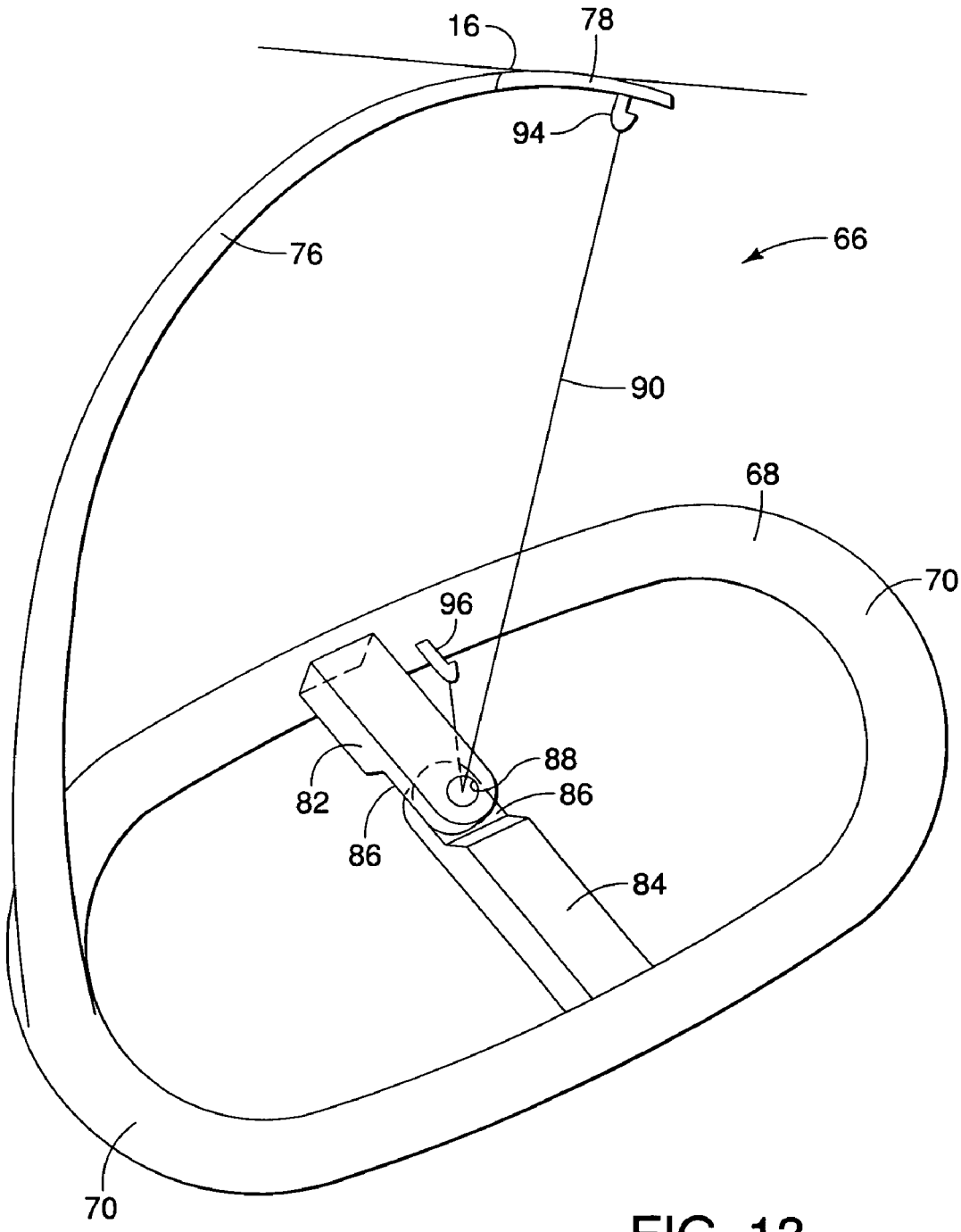
FIG. 13 is perspective view of the sealing mechanism of FIG. 9, shown without the container.

Turning now to FIG. 13, similar in construction and function to the arm 34 described above, an arm 76 at its one end is attached proximate one end 70 of the bridge 68. A stopper 78 is attached to the opposite end of the arm 76 for sealing the opening 16 of the container 10. As with the stopper 30, the stopper 78 is also slightly larger than the opening 16 so that it completely covers the area of the opening. The stopper 78 also includes a sealing ring or gasket 80 on the surface facing the opening 16 (best shown in FIG. 10). The sealing ring 80 has a shape and size to surround the opening 16 and provide a seal around the opening when the stopper 78 is pressed against opening 16.

The bridge 68 further includes a pair of braces 82, 84, which are formed at approximately the mid-point from the two ends 70, and extend inwardly toward each other. The braces 82, 84 each have a ledge 86 on the side facing each other, and a hole 88 is provide on the ledges 86 of both braces, so that the braces engage each other at the ledge and the holes align with each other. In one embodiment, the braces 82, 84 have a substantially rectangular cross section. However, other shapes may also be used such as circular or oval, for example.

In one embodiment, the bridge 68, the arm 76, the stopper 78 and the braces 82, 84 are formed or molded together from plastic in a single integral piece for ease of manufacture. These components of the sealing mechanism 66 may also be formed separately and attached or glued to each other in any known manner. Other suitable material for the stopper 78, the arm 76 and the bridge 68 may include metal wrapped in plastic.

Similar to the connection line 56 described above, a connection line 90 is connected to the stopper 78 at one end and to the bridge 68 at the other end, and is threaded through the holes 88 in the ledge 86 of both braces 82, 84. The connection line 90 may also be a plastic or nylon with a sufficient tensile strength to pull the stopper 78 away from the opening 16 against the force created by the arm 76 toward the top 18 of the container 10. The length of the connection line 90 is such that it allows the stopper 78 to be pressed up against the opening 16 in a closed position. Preferably, the connection line 90 has a slight slack when the stopper 78 is seated against the opening 16. In this manner, the stopper 78 is maintained in the closed position against the opening 16, even when there is an unintentional or accidental deformation of the container 10, causing the stopper 78 to be pulled away from the opening, as described in more detail below.

Referring back to FIG. 6, and similar to an embodiment of the connection line 56, the two ends of the connection line 90 in one embodiment terminate in an integrally formed ball 92. The ball 92 at one end of the connection line 90 is secured to an anchor 94 projecting from the surface of the stopper 78 on the side opposite the surface facing the opening 16, and the other ball 92 is secured to an anchor 96 protruding from the bridge 68 near one of the braces 82, 84 (shown near the brace 82 in FIG. 13). Each of the anchors 94, 96 includes a cup 98 with a slit 100 extending from a lip to a bottom of the cup. The slits 100 enable the two balls 92 to be received in the two cups 98 to connect the connection line 90 to the two anchors 94, 96.

In other embodiments, the connection line 90 is integral with the stopper 78 and the bridge 68, and formed simultaneously along with the stopper 78, the arm 76, the bridge 68 and the pads 72 in a molding process. The connection line 90 may also be glued or otherwise attached or connected to the stopper 78 and bridge 68 in a separate process from the other components of the sealing mechanism 66.

Figure 14:
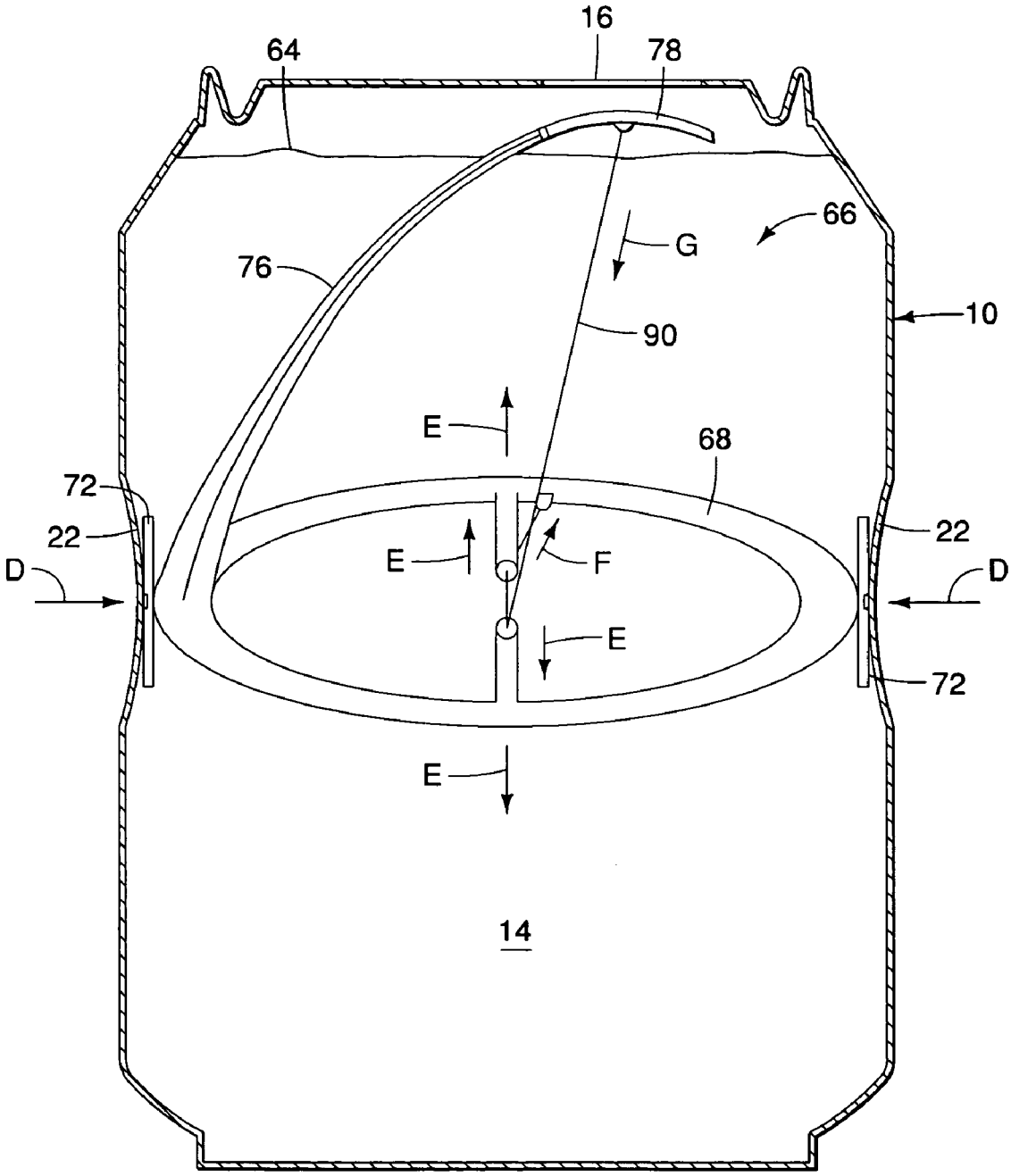
FIGS. 14 and 15 illustrate the opening operation of the sealing mechanism of FIG. 9.
Figure 15:
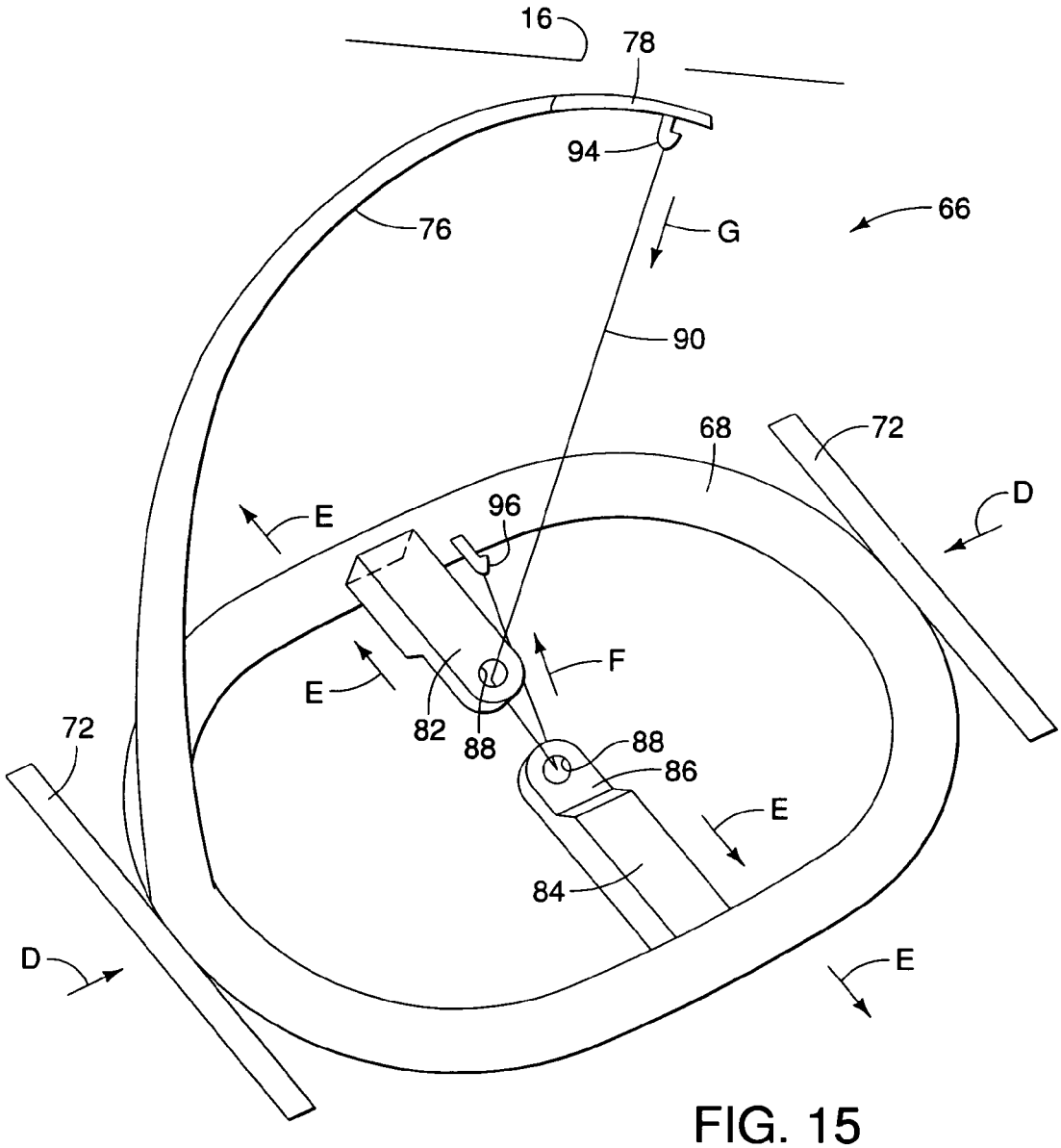

Turning now to FIGS. 9, 14 and 15, and in operation, the sealing mechanism 66 is in a position where the stopper 78 is pressed up against the scored plate 24 (best shown in FIG. 2) when the container 10 is unopened. In other words, the plate 24 is still attached to the top 18 of the container 10 and has not been pulled off. When the plate 24 is detached from the container 12 using the pull-tab 26, the stopper 78 is pressed or pushed up against the opening 16 by the arm 76, i.e., in a closed position as shown in FIG. 9. The sealing mechanism 66 automatically keeps the stopper 78 in a closed position when the container 10 is opened.

To place the sealing mechanism 66 in an open position to allow the content 64 of the container 10 to be released through the opening 16, the side 22 of the container 10 is pressed inwardly at the two pads 72 of the bridge 68 (as indicated by arrows D). This causes the bridge 68 to expand outwardly at approximately the middle of the bridge where the braces 82, 84 are located, (as indicated by arrows E), thereby separating the braces from each other, along with the holes 88.

As the holes 88 in the braces 82, 84 separate, the connection line 90 is pulled toward the anchor 96 on the bridge 68 (in the direction indicated by an arrow F), which causes the stopper 78 to be pulled away from the opening 16 of the container 10 (in the direction indicated by an arrow G), and creating a gap between the stopper 78 and the opening 16. The content 64 of the container 10 is then allowed to exit through the opening 16.

The distance of separation of the two holes 88 corresponds approximately to the inward deformation of the side 22 of the container 10, and slightly longer than the downward travel of the stopper 78 (if there is a slight slack in the connection line 90 when the sealing mechanism 66 is in a closed position). As the operation of the sealing mechanism 66 requires the mid-portion of the bridge 68 to expand outwardly, the diameter of the bridge where the braces 82, 84 are located should be such that the bridge is allowed to expand at the braces to a sufficient amount to place the mechanism in the open position, before or simultaneously coming in contact with the inside 14 of the container 10.

To again place the sealing mechanism 66 in the closed position, the inward pressure at the sides 22 of the container 10 is removed by entirely releasing the thumb and the finger(s) from the pads 46, or sufficiently enough to allow the sides 22 of the container 10 to flex back to the state prior to being deformed. The inherent memory of the bridge 68, and to a lesser extent, the flexibility or memory of the container 10, enables the side 22 of container to regain its shape prior to the application of the pressure. The bridge 68 flexes back to its original elliptical shape prior to the application of the pressure on the side 22 of the container 10. The removal of the tension on the connection line 90 allows the arm 76 to flex away from the bridge 68 and towards the top 18 of the container, where the stopper 78 is again positioned to cover the opening 16 at a tension provided by the arm 76. When the content 64 in the container 10 is a carbonated beverage, for example, pressure created by the gases also assists in pushing the stopper 78 securely against the opening 16.

It should be appreciated that in the closed position, the stopper 30 or 78 of the sealing mechanism 12 or 66 seals the opening 16 of the container 10 automatically, so that its content 64 cannot escape through the opening when the container is shaken or even when the container is knocked over on its side, for example. In the open position, the content 64 is allowed to be poured out of the opening 16 when desired. When the content 64 in the container 10 is a carbonated beverage, for example, the sealing mechanism 12 or 66 prevents the carbonation or gas from escaping through the opening, thereby allowing the beverage to remain carbonated even after the container is opened.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An apparatus for closing an opening created by a removal of a breakable seal on a liquid container, comprising:

a stopper provided inside the container and configured to cover the opening;

an elongated arm having a first end attached to said stopper for exerting a force on said stopper against the opening;

a flexible bridge having two ends which are affixed on opposite sides of the container; and a connection line having a first end secured to said stopper and a second end secured to said bridge;

wherein the opening is opened by applying force towards a middle of said bridge at said two ends and enabling said bridge to pull said stopper away from the opening via said connection line.

2. The apparatus as defined in claim 1, wherein said stopper is configured to be approximately the same shape as the opening.

3. The apparatus as defined in claim 1, wherein said stopper is formed from a flexible impermeable material.

4. The apparatus as defined in claim 1, wherein said stopper includes a gasket for providing a seal around the opening when said stopper is pressed against the opening.

5. The apparatus as defined in claim 1, wherein said arm further includes a second end fixedly attached proximate one of said two ends, said arm being configured and positioned to be in tension toward the opening.

6. The apparatus as defined in claim 5, wherein a thickness of said arm narrows toward said first end.

7. The apparatus as defined in claim 1, wherein said bridge comprises a pad formed at each of said two ends, and said force is applied at said pads to enable said bridge to pull said stopper away from the opening.

8. The apparatus as defined in claim 1, wherein said two ends of said bridge are affixed to the container by a post projecting from said opposite sides of said container.

9. The apparatus as defined in claim 1, wherein said connection line is formed from plastic or nylon.

10. The apparatus as defined in claim 1, wherein said connection line terminates in a ball at said first and second ends, and said balls are each received in an anchor fixed to said stopper and said bridge.

11. The apparatus as defined in claim 1, wherein said bridge comprises a hinged portion at approximately at said middle of said bridge, said hinged portion being configured and constructed to bend away from said stopper when said force is applied to said two ends.

12. The apparatus as defined in claim 11 wherein said second end of said connection line is secured proximate said hinged portion.

13. The apparatus as defined in claim 11, wherein said bridge comprises a slit extending transversely to the longitudinal direction at said hinged portion.

14. The apparatus as defined in claim 1, wherein said bridge comprises an elliptical ring, and said two ends are located approximate opposite two points on said ring.

15. The apparatus as defined in claim 14, wherein said bridge further comprises:

a pair of braces located at opposite two points on said ring; and a through hole formed on each of said braces and overlapping each other;

wherein said connection line is routed through said holes so that when said force is applied at said two ends of said bridge, the holes separate from each other and pull said connection line and said stopper away from the opening.

16. The apparatus as defined in claim 1, wherein the liquid container is a metal can.

17. A liquid container having an apparatus for sealing and unsealing an opening created by a removal of a breakable seal on the container, comprising:

a stopper provided inside the container and configured to overlap the opening;

an elongated arm having a first end attached to said stopper for exerting a force on said stopper against the opening;

a flexible bridge having two ends which are affixed on opposite sides of the container; and a connection line having a first end secured to said stopper and a second end secured to said bridge;

wherein the opening is opened by applying an inward force on the container proximate said two ends and enabling said bridge to pull said stopper away from the opening via said connection line.

18. A beverage can having a self-closing stopper for an opening of the can, said can comprising:

a top having a breakable seal for creating the opening when said seal is removed;

a stopper provided inside the can and configured to overlap the opening;

an elongated arm having a stationary first end and a second end attached to said stopper for exerting a force on said stopper against the opening;

a flexible bridge having two ends which are affixed on opposite side of the can; and a connection line having a first end secured to said stopper and a second end secured to said bridge;

wherein the opening is closed by a force exerted on said stopper against the opening by said arm when said seal is removed, and opened by applying an inward force on the can proximate said two ends and enabling said bridge to pull said stopper away from the opening via said connection line.

19. The can as defined in claim 18, further comprising a post projecting inwardly from said opposite side for affixing said two ends of said bridge.

20. The can as defined in claim 18, wherein said bridge comprises;

an elliptical ring, said two ends being located approximate opposite two points on said ring;

a pair of braces located at opposite two points on said ring; and a through hole formed on each of said braces and overlapping each other;

wherein said connection line is routed through said holes so that when said force is applied on the can, the holes separate from each other and pull said connection line and said stopper away from the opening.

* * * * *